US008365746B2

(12) United States Patent
Chen

(10) Patent No.: US 8,365,746 B2
(45) Date of Patent: Feb. 5, 2013

(54) SAFELY OPERABLE HANDLE DEVICE FOR AN AUTOMATIC FOLDABLE UMBRELLA

(76) Inventor: Hsia-Hui Chen, Jhubei (TW)

( * ) Notice: Subject to any disclaimer, the term of this patent is extended or adjusted under 35 U.S.C. 154(b) by 20 days.

(21) Appl. No.: 13/070,676

(22) Filed: Mar. 24, 2011

(65) Prior Publication Data

US 2012/0138112 A1 Jun. 7, 2012

(30) Foreign Application Priority Data

Dec. 2, 2010 (CN) ..... 2010 1 0569887

(51) Int. Cl.
*A45B 25/16* (2006.01)

(52) U.S. Cl. ..... 135/24

(58) Field of Classification Search ..... 135/22, 135/24

See application file for complete search history.

(56) References Cited

U.S. PATENT DOCUMENTS 8,151,811 B2 * 4/2012 Chong ..... 135/20.3
8,225,805 B2 * 7/2012 Wu et al. ..... 135/24
8,286,650 B2 * 10/2012 Chong ..... 135/22
2011/0048479 A1 * 3/2011 Kuo ..... 135/20.3
2011/0284043 A1 * 11/2011 Kuo ..... 135/24
2012/0180833 A1 * 7/2012 Kuo ..... 135/24

* cited by examiner

*Primary Examiner* — Noah Chandler Hawk

(74) *Attorney, Agent, or Firm* — Fitzpatrick, Cella, Harper & Scinto

(57) ABSTRACT

A safely operable handle device for an automatic foldable umbrella includes a grip shell coupled with a telescopic central shaft unit, a retained block releasably blocked to hold the umbrella in an opened state, a reel member rotatably mounted in the grip shell and biased to reel in a force transmission cord to restrict extending movement of the central shaft unit, a pawl member movable to engage or disengage from a ratchet tooth of the reel member, and a force-transmitting mechanism urged to move from a lower position to an upper position, and having a camming surface mated with a cammed surface of the pawl member to move the pawl member to engage the ratchet tooth so as to prevent undesirable unfolding of the central shaft unit as a result of accidental slip-off during folding.

10 Claims, 16 Drawing Sheets

SAFELY OPERABLE HANDLE DEVICE FOR AN AUTOMATIC FOLDABLE UMBRELLA

CROSS-REFERENCE TO RELATED APPLICATION

This application claims priority of Chinese Patent Application No. 201010569887.8, filed on Dec. 2, 2010, the disclosure of which is herein incorporated by reference.

BACKGROUND OF THE INVENTION

1. Field of the Invention

This invention relates to an automatic foldable umbrella, more particularly to a safely operable handle device for automatically spreading and collapsing a canopy of the umbrella.

2. Description of the Related Art

Referring to FIG. 1, a conventional auto-umbrella capable of automatic opening and closing such as that disclosed in Taiwanese Utility Model Publication No. 354874 is shown to include a frame 1, a handgrip 3 mounted on a lower end of the central shaft 101 for mounting a control unit 4 therein, and a transmitting mechanism 5 coupling the handgrip 3 to the frame 1. By engagement of a lever 401 of the control unit 4 with an upper shaft 101', the central shaft 101 is kept in a telescopically folded state. Pushing a button 402 results in disengagement of the lever 401 from the upper shaft 101' to permit telescopic extension of the central shaft 101 by means of the opening spring 2 and to move a runner 103 upwardly toward an upper hub 102 so as to spread a rib-and-stretcher assembly 104 for opening the umbrella. When it is desired to close the umbrella, the button 402 is pushed, and a lower end of the lever 401 is brought to move a biased plate 403 to release a retaining member 501 to thereby permit downward movement of the runner 103 for collapsing the rib-and-stretcher assembly 104. Subsequently, the central shaft 101 can be pushed downward and telescopically folded. However, when pushing down the central shaft 101 for folding the same, the user needs to apply a relatively large force to the central shaft 101 to overcome the biasing action of the opening spring 2. If the user inadvertently lets the umbrella slip from his/her grasp during pushing, the central shaft 101 may extend and the rib-and-stretcher assembly 104 may spread instantly, which may result in damage to the umbrella and injury to the user and people nearby.

In U.S. Pat. No. 7,798,160 B2, the applicant disclosed a safely operable handle device for an automatic foldable umbrella that includes a reel member disposed to reel a cord which is coupled to a top notch or a retained block, an actuator, and a unidirectional retaining mechanism. Upon application of a pressing force to telescopically fold the central shaft of the umbrella, and upon movement of the actuator, the reel member turns to reel in the cord, and is prevented from turning in a reel-out direction so as to hold the central shaft in position for avoiding undesirable extension of the central shaft.

It is desirable to improve the aforesaid handle device to simplify the construction and operation thereof.

SUMMARY OF THE INVENTION

An object of the present invention is to provide a safely operable handle device for an automatic foldable umbrella which has a simple construction to easily operate and which can prevent undesirable opening of the umbrella during folding.

According to this invention, the safely operable handle device of an automatic foldable umbrella includes a grip shell adapted to shield a bottom end of a central shaft unit, and defining a chamber therein, a retained block adapted to be connected with a first force transmission cord, and deflectable between a first orientation, where the retained block is blocked so as to hold the first force transmission cord in a tugged position, and a second orientation, where the retained block is movable to permit the first force transmission cord to be withdrawn to a released position, a safety unit, and a push button unit. The safety unit includes a reel member rotatably mounted in the chamber and having a plurality of ratchet teeth, a second force transmission cord having a connected end which is moved with one of a top notch and the retained block, and a reelable end which is secured to and is tensely reelable on the reel member, a coil spring disposed to bias the reelable end to reel in the reel member, and a pawl member having a pawl end which is movable between an engaging position, where the pawl end is engaged with a selected one of the ratchet teeth so as to permit a unidirectional rotation of the reel member to reel in the reelable end, and a disengaged position, where the pawl end is disengaged from the ratchet teeth so as to set the reel member free to rotate, and a cammed surface. The push button unit includes a push button pressible manually to make a stroke movement relative to the grip shell, an actuator configured to move in response to the stroke movement of the push button to activate the retained block to deflect from the first orientation to the second orientation so as to permit a runner to move from a proximate position to a distal position relative to the top notch for collapsing a rib-and-stretcher assembly, and a force-transmitting mechanism disposed in the chamber and configured such that, in response to movement of the retained block to the released position, the force-transmitting mechanism is urged to move from a lower position to an upper position. The force-transmitting mechanism has a camming surface mated with the cammed surface of the pawl member such that, when the force-transmitting mechanism is moved from the lower position to the upper position, the pawl end is moved from the disengaged position to the engaging position.

By the movement of the pawl end to the engaging position when the rib-and-stretcher assembly is collapsed, undesired unfolding of the central shaft unit and opening of the umbrella, which may cause injury to the user or people nearby can be avoided during folding operation of the central shaft unit.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
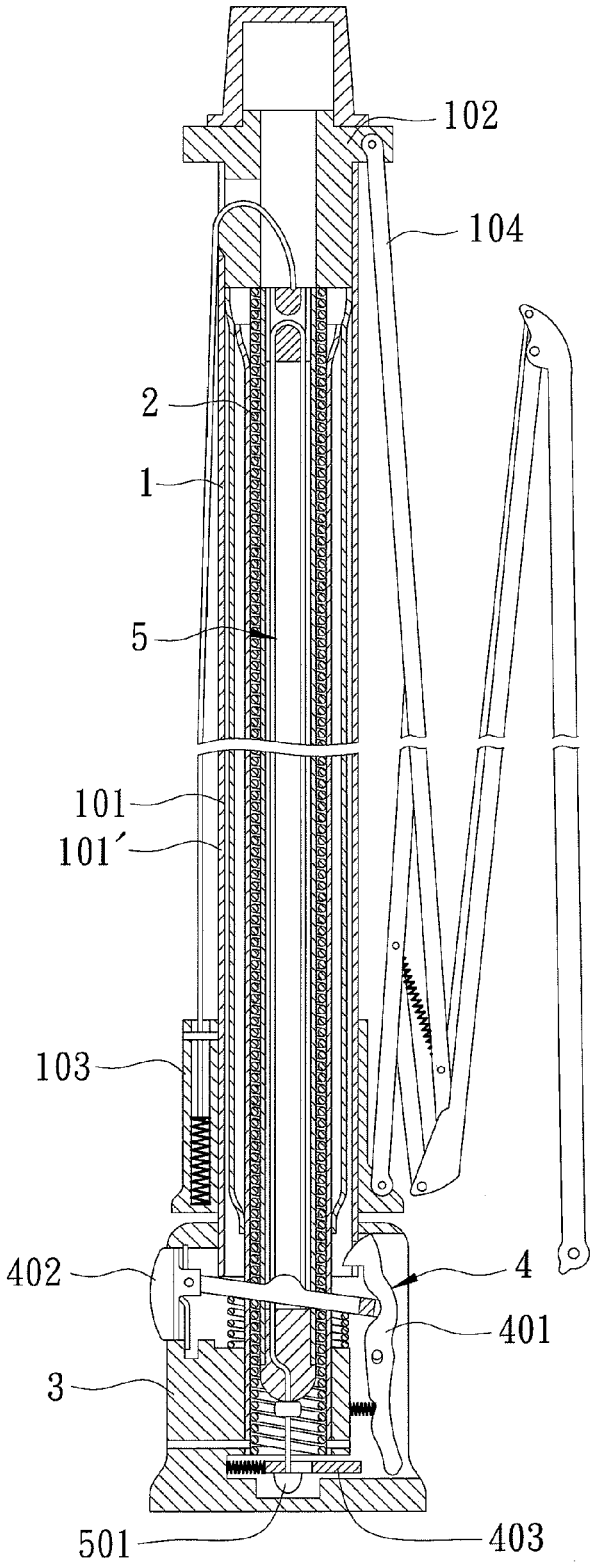
FIG. 1 PRIOR ART
FIG. 1 is a sectional view of a conventional automatic foldable umbrella.

Before the present invention is described in greater detail, it should be noted that same reference numerals have been used to denote like elements throughout the specification.

Figure 2:
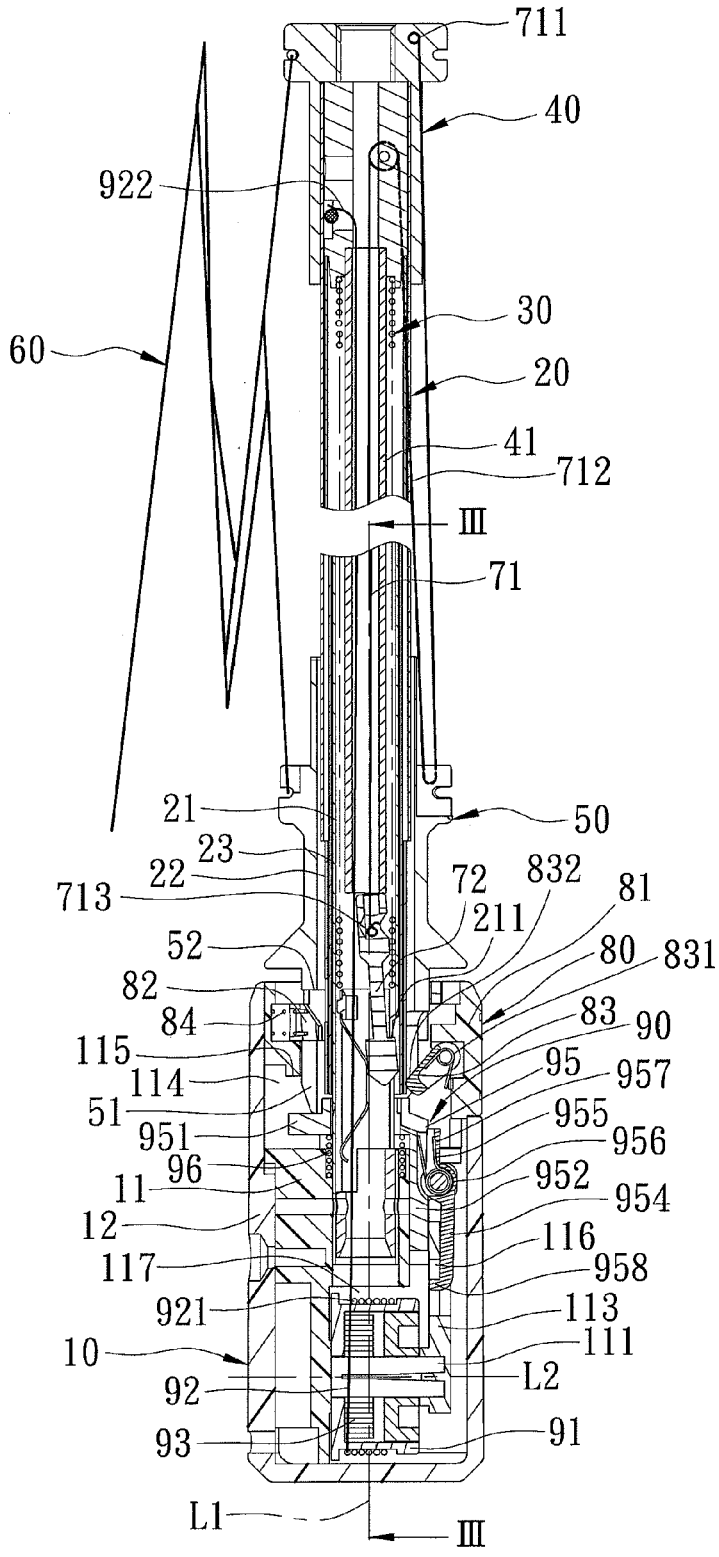
FIG. 2 is a sectional view of the first preferred embodiment of a safely operable handle device according to this invention when incorporated in an automatic foldable umbrella.

Referring to FIG. 2, the preferred embodiment of a safely operable handle device for an automatic foldable umbrella according to the present invention is adapted for use in an automatic foldable umbrella.

The umbrella includes a central shaft unit 20, a top notch 40, a runner 50, a rib-and-stretcher assembly 60, a compression spring 30, and a first force transmission cord 71. The central shaft unit 20 includes upper, middle, and lower shafts 22, 23, 21 telescopically coupled to one another in an axial direction (L1). The upper and lower shafts 22, 21 respectively have a top-side end and a bottom end. The top notch 40 is secured to the top-side end of the upper shaft 22 to be moved therewith between folded and extended positions. A tubular restricting member 41 extends downwardly from the top notch 40 to be disposed in the central shaft unit 20. The runner 50 is slidably sleeved on the upper shaft 22 of the central shaft unit 20. The rib-and-stretcher assembly 60 pivotally interconnects the top notch 40 and the runner 50 so as to be moved from a collapsed position to a spread position when the runner 50 is displaced from a distal position to a proximate position relative to the top notch 40. The compression spring 30 is disposed within the central shaft unit 20 to bias the top-side end of the upper shaft 22, together with the top notch 40 to move from the folded position to the extended position, and in succession, to move the runner 50 from the distal position to the proximate position, thereby placing the rib-and-stretcher assembly 60 in the spread position. The first force transmission cord 71 has a coupling end 711 tensely moved with the top notch 40, and a cord segment 712 which extends from the coupling end 711 into the central shaft unit 20 through winding on the runner 50 and terminates at an anchoring end 713. The anchoring end 713 is kept in a tugged position when the runner 50 is displaced to the proximate position, and is withdrawn to a released position to permit the runner 50 to be moved to the distal position, thereby bringing the rib-and-stretcher assembly 60 to the collapsed position.

Referring to FIGS. 2 to 5, the safely operable handle device according to this invention is shown to comprise a grip shell 10, a press member 51, a retained block 72, a safety unit 90, and a push button unit 80.

The grip shell 10 includes an outer shell 12 defining a chamber therein, and an inner frame 11 disposed in the outer shell 12 to divide the chamber into upper and lower sub-chambers 114, 117. The upper sub-chamber 114 is adapted to accommodate the bottom end of the lower shaft 21. The inner frame 11 has a ceiling portion 115 disposed in the upper sub-chamber 114, a reel axle 111 disposed in the lower sub-chamber 117 and extending along a reel axis (L2) transverse to the axial direction (L1), a pivot pin 112 disposed in the lower sub-chamber 117 and extending along a pivot axis parallel to the reel axis (L2), an anchored plate 113 secured to the reel axle 111 and having an anchored portion 116 in the form of an elongate hole.

In this embodiment, the press member 51 is configured to extend from the runner 50 in the axial direction (L1) to be inserted into the upper sub-chamber 114 when the runner 50 is in the distal position, and to terminate at a lower press portion 511. The press member 51 has a retaining hole 52.

The retained block 72 is adapted to be connected with the anchoring end 713 of the first force transmission cord 71, and which is deflectable between a first orientation, where the retained block 72 is blocked by a block portion 211 of the lower shaft 21 so as to hold the anchoring end 713 in the tugged position, and a second orientation, where the retained block 72 is disengaged from the block portion 211 to be movable so as to permit the anchoring end 713 to be withdrawn to the released position.

The safety unit 90 includes a reel member 91, a second force transmission cord 92, a coil spring 93, a pawl member 94, a pawl biasing member 942, a force-transmitting mechanism 95, and an axially biasing member 96.

The reel member 91 is mounted on the reel axle 111 to be rotatable about the reel axis (L2), and has a plurality of ratchet teeth 911 angularly displaced from one another about the reel axis (L2). The second force transmission cord 92 has a connected end 922 connected to and moved with the top notch 40, and a reelable end 921 secured to and tensely reelable on the reel member 91. It is noted that the connected end 922 may be alternatively connected to and moved with the retained block 72. The coil spring 93 is disposed in the reel member 91 to bias the reelable end 921 to reel in the reel member 91.

The pawl member 94 has a pivoted end 943 pivotally mounted on the pivot pin 112 about the pivot axis, a pawl end 944 disposed opposite to the pivoted end 943 and angularly movable about the pivot axis between an engaging position (see FIG. 10), where the pawl end 944 is engaged with a selected one of the ratchet teeth 911 so as to permit a unidirectional rotation of the reel member 91 to reel in the reelable end 921, and a disengaged position (see FIG. 4), where the pawl end 944 is disengaged from the ratchet teeth 911 so as to set the reel member 91 free to rotate, and a middle segment 941 disposed between the pivoted and pawl ends 943, 944 and formed with a cammed surface 945. The pawl biasing member 942 is a torsion spring disposed to bias the pawl end 944 of the pawl member 94 to the engaging position.

The force-transmitting mechanism 95 includes a tubular abutment member 951 coaxially moved relative to the bottom end of the lower shaft 21 between lower and upper positions, and an anchored mount 952 extending downwardly from the abutment member 951 toward the lower sub-chamber 117 to terminate at a cam end that has a camming surface 953 mated with the cammed surface 945 of the pawl member 94. The abutment member 951 confronts the ceiling portion 115 in the axial direction (L1). The force-transmitting mechanism 95 further includes a lever 954 and a lever biasing member 955. The lever 954 has a fulcrum 956 pivotally mounted on the anchored mount 952, a power end 957, and a weight end 958 turnable between an anchoring position (see FIG. 2), where the weight end 958 anchors the anchored portion 116 so as to keep the force-transmitting mechanism 95 in the lower position, and a non-anchoring position (see FIG. 8), where the weight end 958 is disengaged from the anchored portion 116 so as to permit displacement of the force-transmitting mechanism to the upper position. The lever biasing member 955 is disposed to bias the weight end 958 to the anchoring position. The axially biasing member 96 is disposed to bias the force-transmitting mechanism 95 to the upper position.

The push button unit 80 includes a push button 81, a button biasing member 84, and an actuator 83.

The push button 81 is disposed in the upper sub-chamber 114, and is pressible manually to make upper-side and lower-side stroke movements relative to the grip shell 10. The push button 81 has a retained protrusion 82 which is disposed to be retained in the retaining hole 52 so as to hold the top notch 40 in the folded position against a biasing force of the compression spring 30 and which is disposed to be releasable from the retaining hole 52 in response to the upper-side stroke movement of the push button 81. The button biasing member 84 is disposed to bias the retained protrusion 82 to be retained in the retaining hole 52.

The actuator 83 has a pressed end 831 pivotably mounted on the push button 81 and biased by a coil spring, and an actuating end 832 turnable between a non-actuatable position (see FIG. 2), where the actuating end 832 is disengaged from the retained block 72, and an actuatable position (see FIG. 6), where the actuating end 832 is engaged with the retained block 72.

Figure 3:
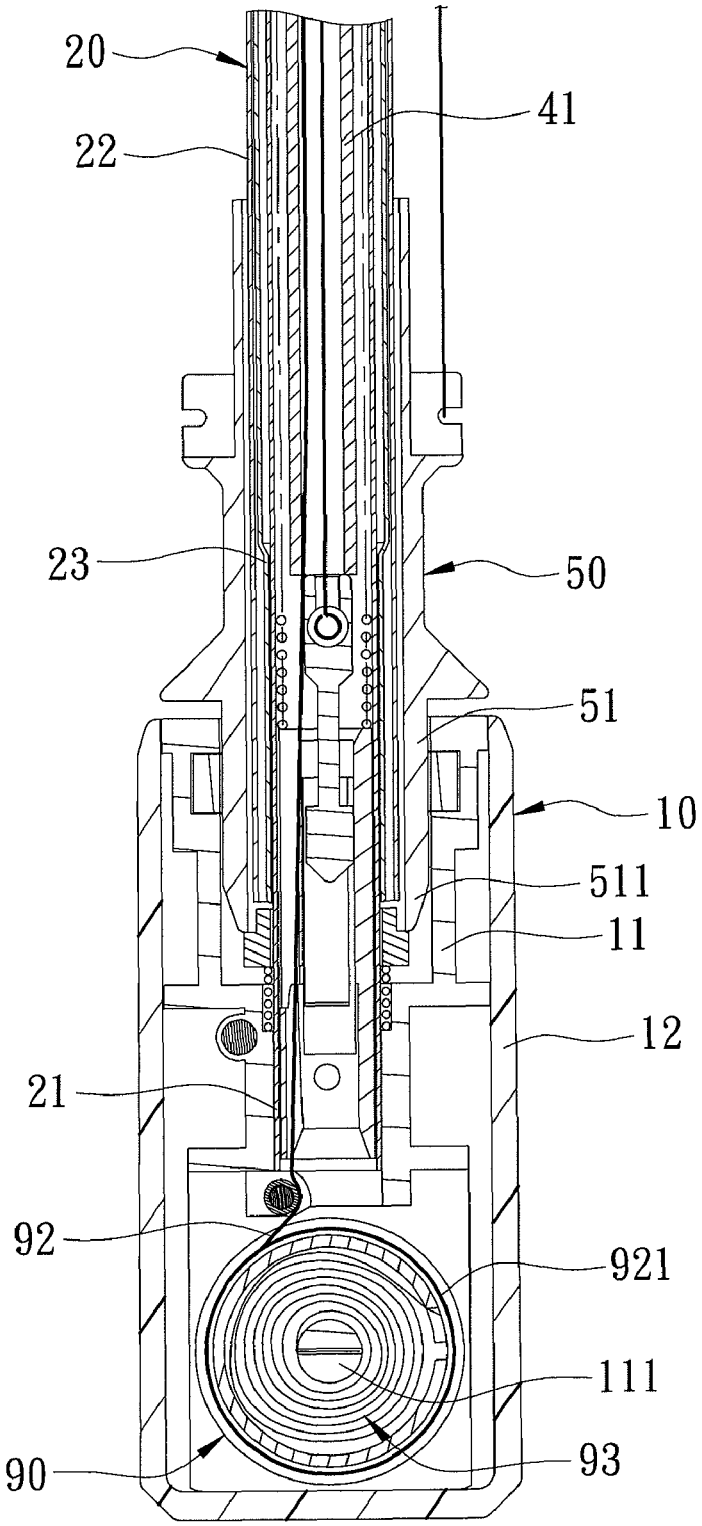
FIG. 3 is a sectional view taken along line III-III of FIG. 2.
Figure 4:
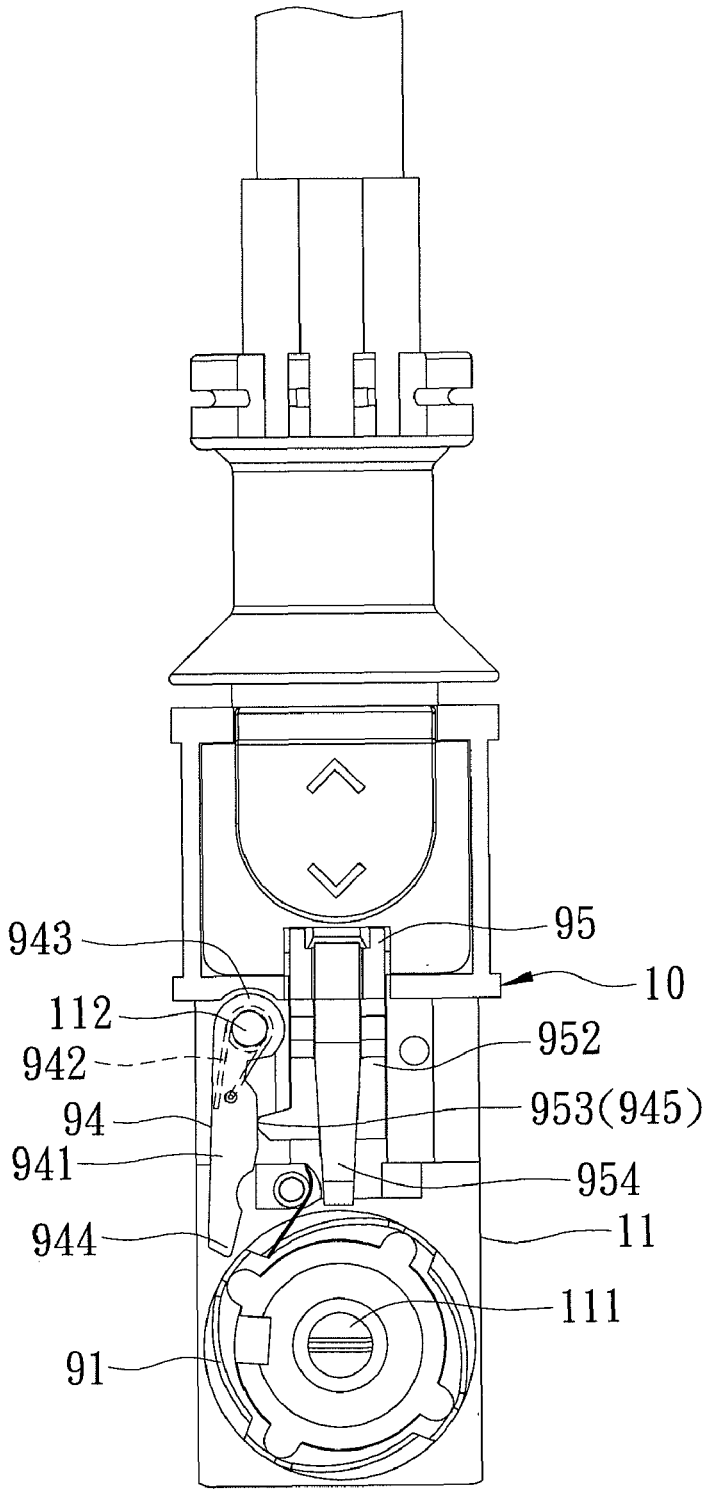
FIG. 4 is a sectional view taken along line IV-IV of FIG. 2.
Figure 5:
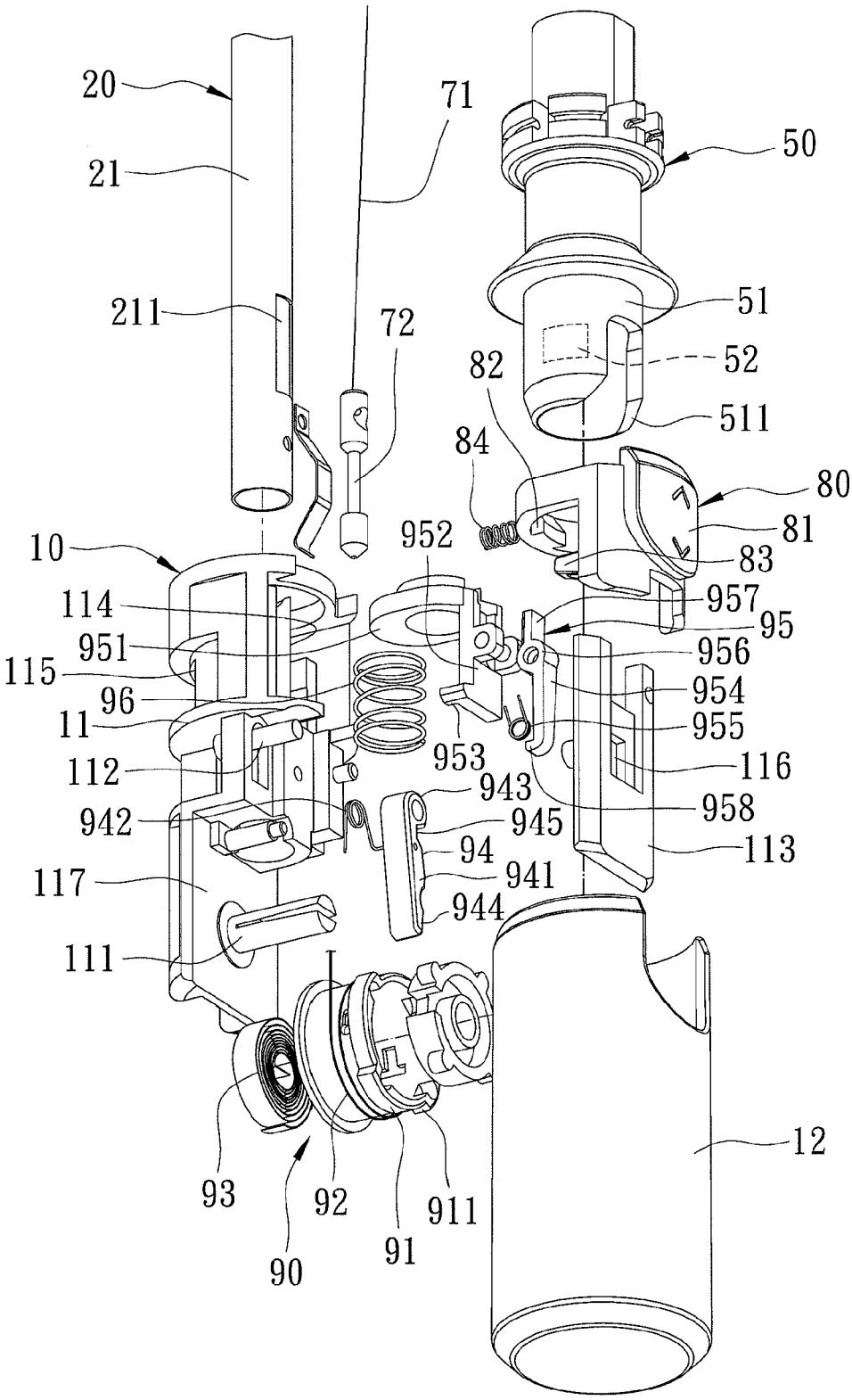
FIG. 5 is an exploded perspective view of the first preferred embodiment.

Referring to FIGS. 2 to 4, when the central shaft unit 20 is in the folded position, the runner 50 is in the distal position while the retained protrusion 82 is retained in the retaining hole 52, and the rib-and-stretcher assembly 60 is in the collapsed position. Meanwhile, the second force transmission cord 92 is in a complete reeled-in state in the reel member 91. The abutment member 951 is pressed by the lower press portion 511 so as to be held in the lower position while permitting the pawl end 944 to be held in the disengaging position by virtue of engagement between the camming surface 953 and the cammed surface 945, and the reel member 91 is set free to rotate.

Figure 6:
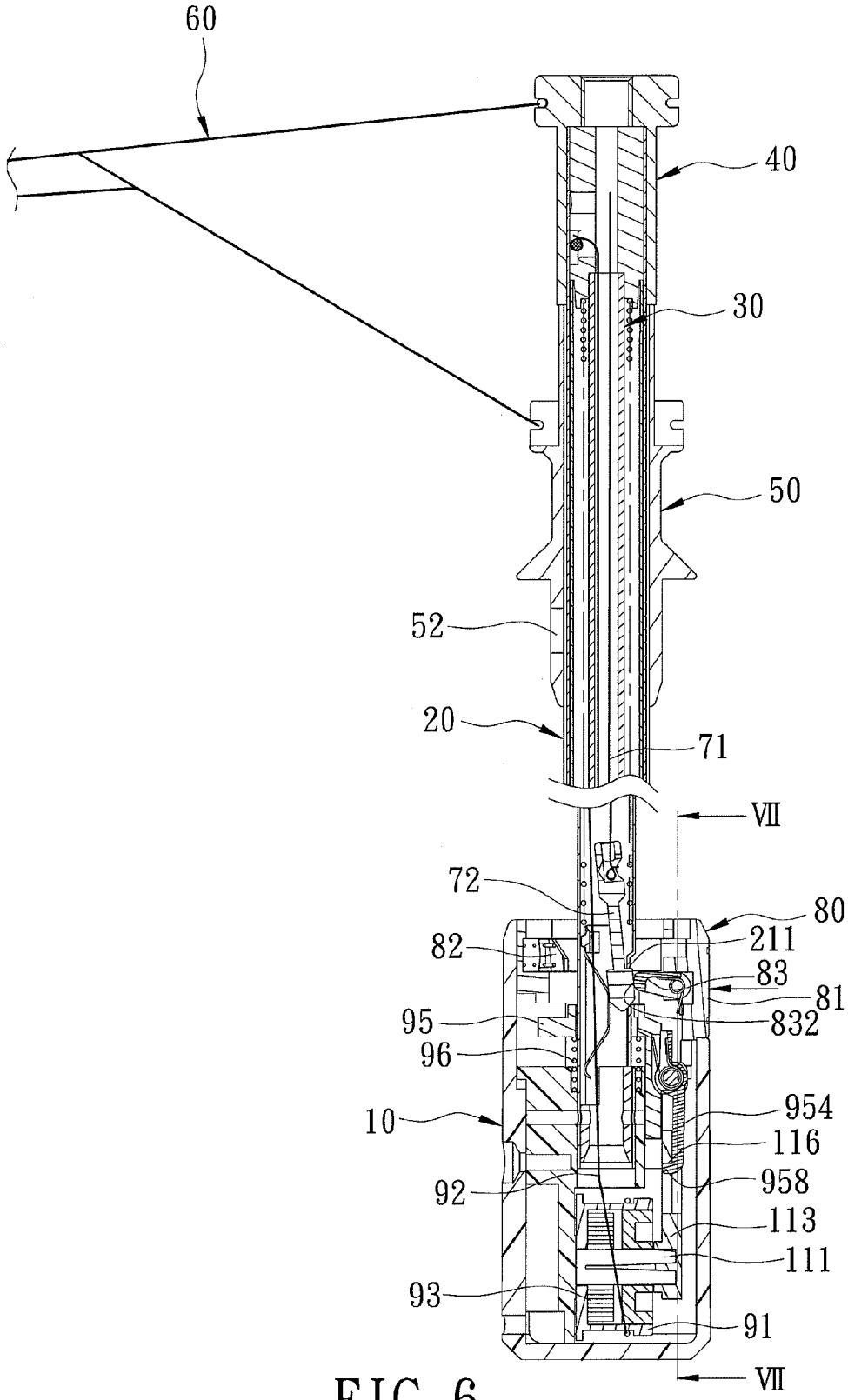
FIG. 6 is a sectional view showing the automatic foldable umbrella incorporating the first preferred embodiment in a stretched state.
Figure 7:
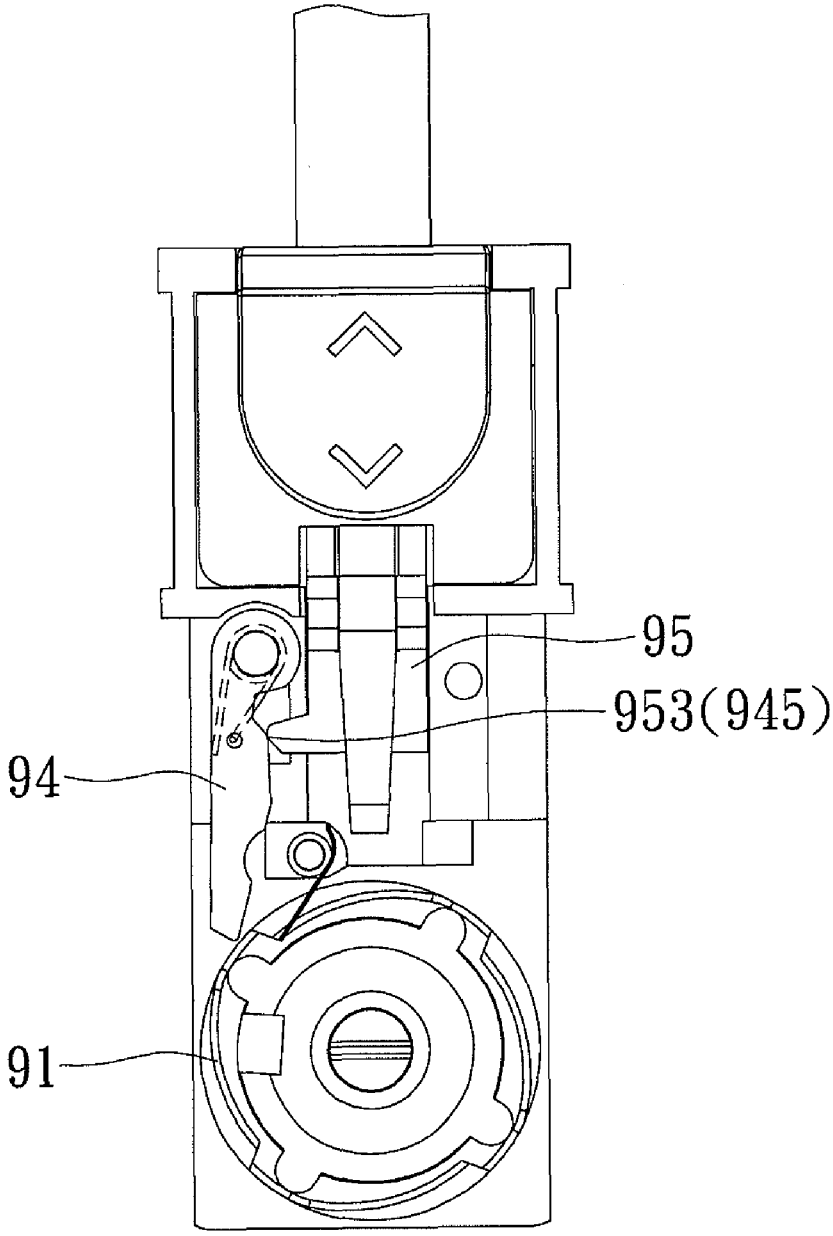
FIG. 7 is a sectional view taken along line VII-VII of FIG. 6.

Referring to FIGS. 6 and 7, when it is desired to open the umbrella, the push button 81 is pressed manually to make the upper-side stroke movement so that the retained protrusion 82 is released from the retaining hole 52. The top-side end of the central shaft unit 20, together with the top notch 40, is moved from the folded position to the extended position by virtue of a biasing action of the compression spring 30, and the runner 50 is in succession, urged to move to the proximate position, thereby placing the rib-and-stretcher assembly 60 in the spread position while the retained block 72 is retained at the block portion 211 to thereby hold the first force transmission cord 71 in the tugged position. Meanwhile, the actuating end 832 of the actuator 83 is turned to the actuatable position and engages the retained block 72. The force-transmitting mechanism 95 is slightly moved upwardly due to relief of the press member 51, but is held in the lower position by engagement between the weight end 958 and the anchored portion 116 so as to keep the pawl end 944 in the disengaging position.

Figure 8:
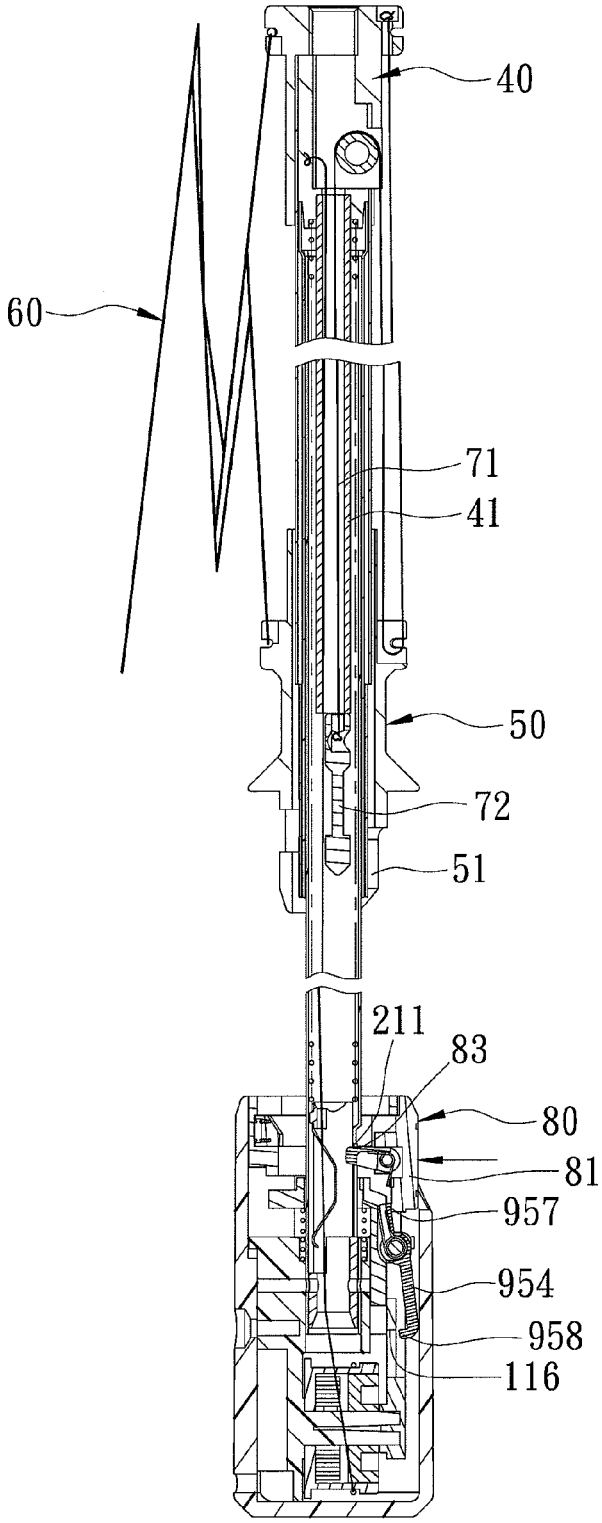
FIG. 8 is a sectional view showing the automatic foldable umbrella operated from the stretched state to a collapsed state.

Referring to FIG. 8, when it is desired to close the umbrella, the push button 81 is pressed manually to make the lower-side stroke movement so that the actuator 83 is moved to activate the retained block 72 to deflect from the first orientation to the second orientation so as to permit movement of the retained block 72 and the first force transmission cord 71 to the released position, and movement of the runner 50 to the distal position for collapsing the rib-and-stretcher assembly 60. The upward movement of the retained block 72 is stopped by the restricting member 41. At the same time, the power end 957 of the lever 954 is pressed by a lower-side stroke movement of the push button 81 to turn the weight end 958 to the non-anchoring position. Hence, referring to FIGS. 9 and 10, the force-transmitting mechanism 95 is urged by the axially biasing member 96 to move upwardly to the upper position until the abutment member 951 abuts against the ceiling portion 115. Meanwhile, by virtue of sweeping engagement of the camming surface 953 with the cammed surface 945, the pawl end 944 is displaced from the disengaged position to the engaging position by a biasing action of the pawl biasing member 942 so as to permit the reel member 91 to be biased to rotate uni-directionally to reel in the second force transmission cord 92.

Figure 9:
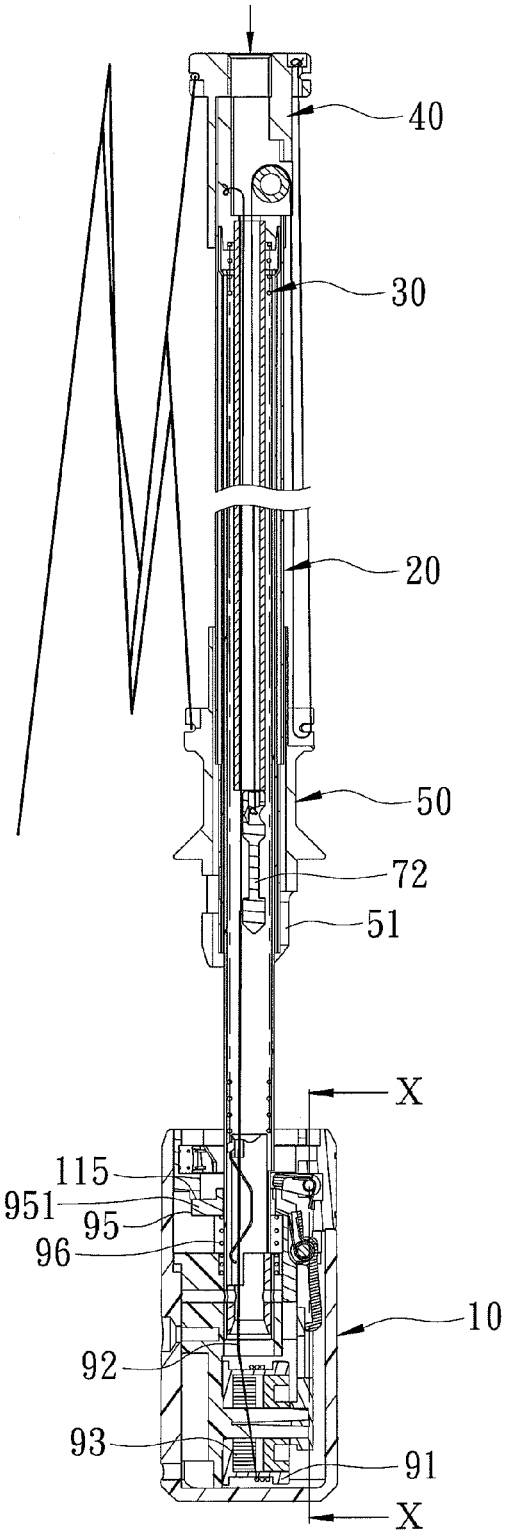
FIG. 9 is a sectional view showing the automatic foldable umbrella in the collapsed state.
Figure 10:
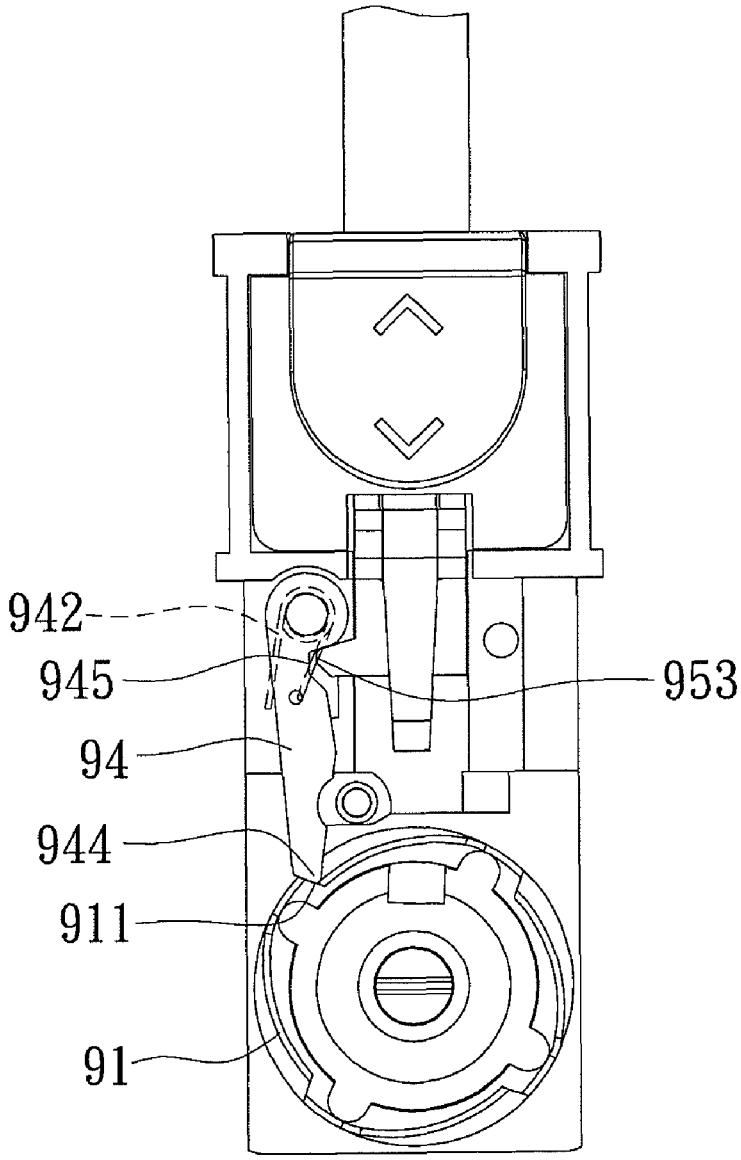
FIG. 10 is a sectional view taken along line X-X of FIG. 9.

Referring to FIGS. 9 and 10, when it is desired to telescopically fold the central shaft unit 20 of the umbrella, a pressing force is applied to move the top notch 40 and the grip shell 10 toward each other against the biasing action of the compression spring 30 while the reel member 91 is rotated by a biasing action of the coil spring 93 to reel in the second force transmission cord 92. Concurrently, the press member 51 is brought to move downwardly to press the force-transmitting mechanism 95 back to the lower position against the biasing action of the axially biasing member 96. Once the retained protrusion 82 is brought to be snapped in the retaining hole 52, the umbrella is locked in the folded state as shown in FIGS. 2 to 4.

During folding of the central shaft unit 20, if the user inadvertently loses grip of the grip shell 10 or the top notch 40, as shown in FIG. 10, due to the engagement between the pawl end 944 and the ratchet tooth 911, the reel member 91 can be constantly guarded against rotation in a reel-out direction (in a clockwise direction of FIG. 10) so as to prevent rebounding movement of the second force transmission cord 92 and the top notch 40, thereby holding the runner 50, the central shaft unit 20, and the rib-and-stretcher assembly 60 in position. Thus, undesirable extension and opening of the umbrella, which may cause injury to the user or people nearby can be avoided.

It is noted that, according to this invention, by virtue of the lower-side stroke movement of the push button 81, the rib-and-stretcher assembly 60 is moved to the collapsed position while the pawl end 944 is moved to the engaging position, thereby rendering folding operation of the central shaft unit 20 easy and convenient without the need to press manually any button to keep engagement of the pawl end 944 with the ratchet tooth 911.

Figure 11:
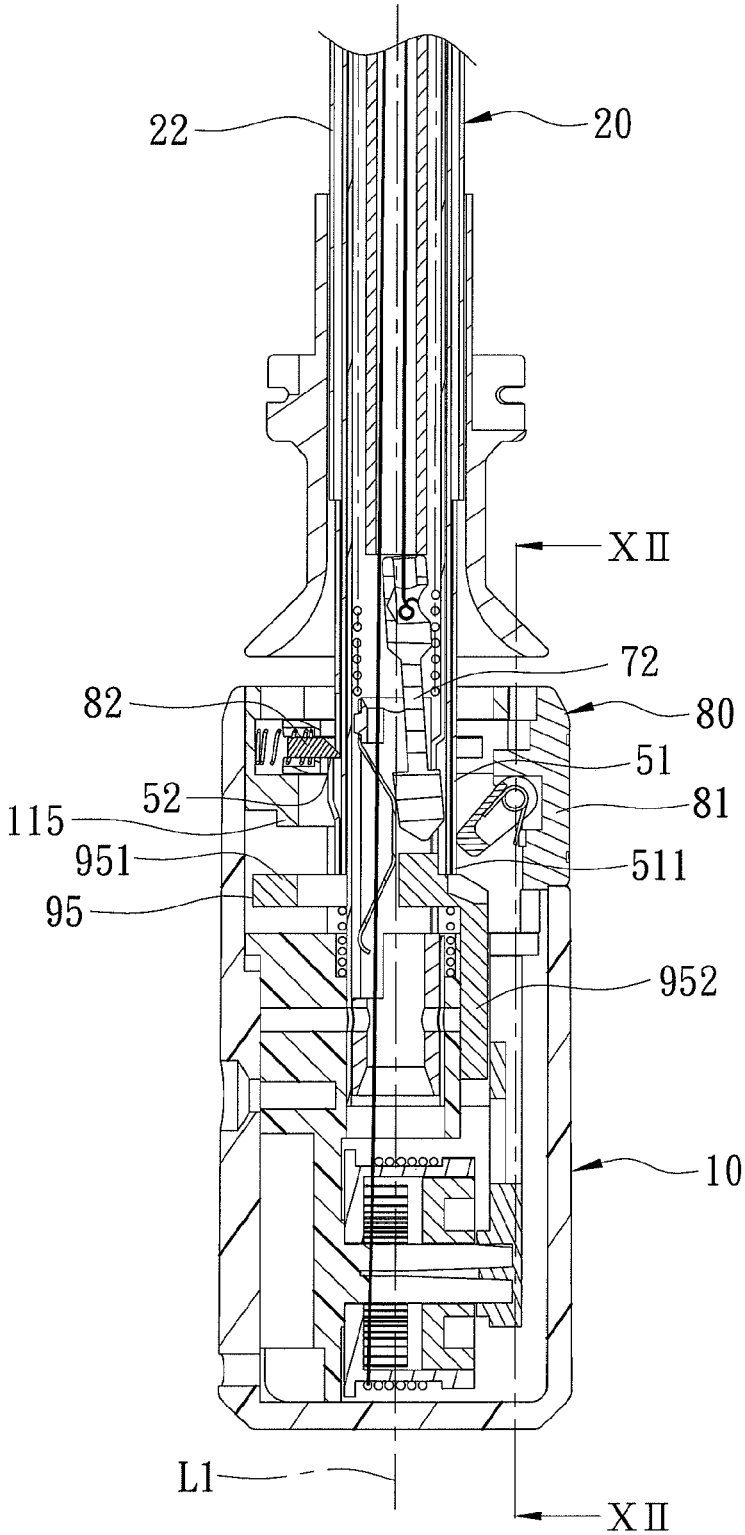
FIG. 11 is a sectional view of the second preferred embodiment when incorporated in an automatic foldable umbrella.
Figure 12:
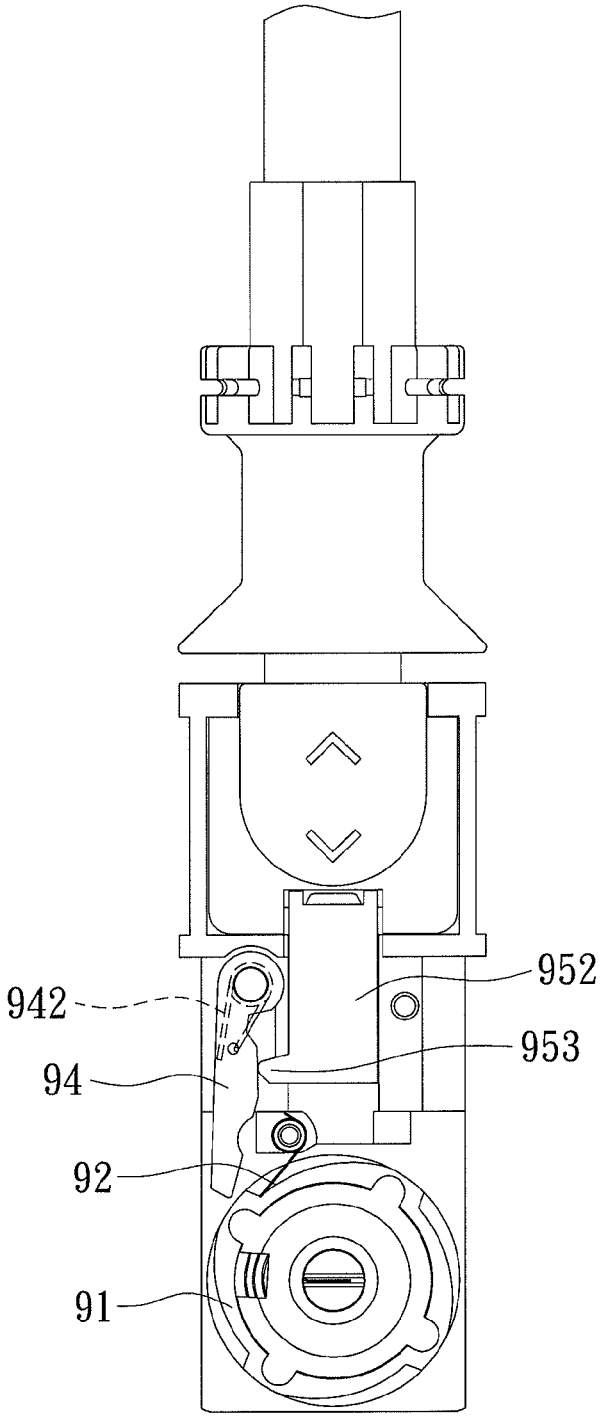
FIG. 12 is a sectional view taken along line XII-XII of FIG. 11.

Referring to FIGS. 11 and 12, the second preferred embodiment of a safely operable handle device according to this invention is shown to be similar to the first embodiment in construction. In the second embodiment, the press member 51 is configured to extend from the upper shaft 22 away from the top notch 40 to terminate at a lower press portion 511 that is configured to counteract the abutment member 951 of the force-transmitting mechanism 95 against the biasing action of the axially biasing member 96 so as to keep the force-transmitting mechanism 95 in the lower position when the central shaft unit 20 is in the folded position. The press member 51 has a retaining hole 52 such that the retained protrusion 82 of the push button 81 is retained in the retaining hole 52 to hold the central shaft unit 20 and the top notch 40 in the folded position against a biasing force of the compression spring 30, and such that the retained protrusion 82 is releasable from the retaining hole 52 in response to the upper-side stroke movement of the push button 81. In this embodiment, the lever 954 and the lever biasing member 955 of the first embodiment are dispensed with.

Figure 13:
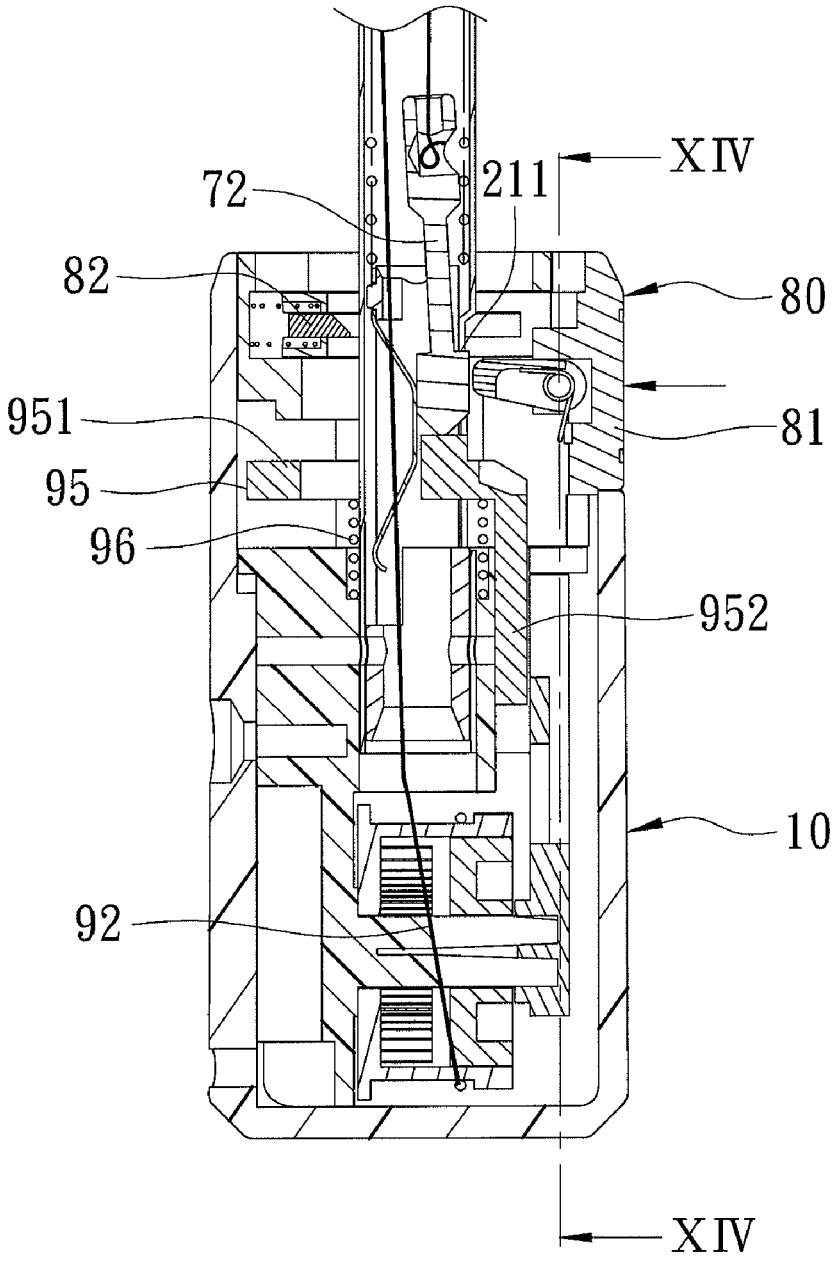
FIG. 13 is a sectional view showing the umbrella in a stretched state.
Figure 14:
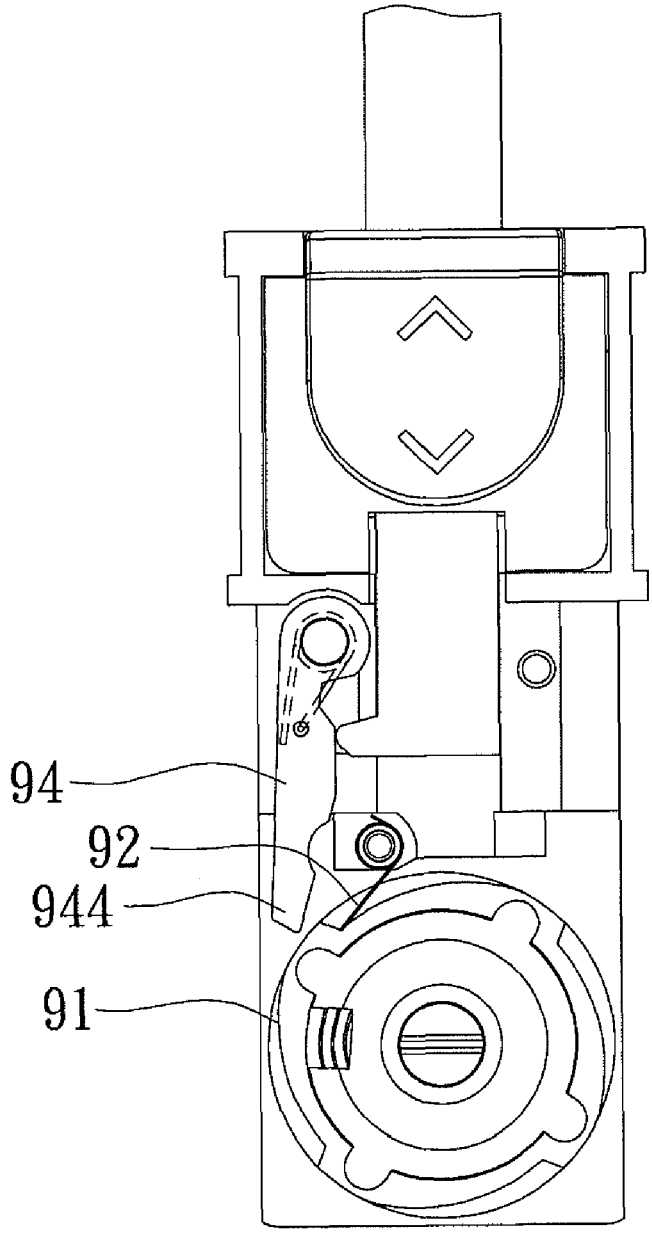
FIG. 14 is a sectional view taken along line XIV-XIV of FIG. 13.

As shown in FIGS. 13 and 14, the force-transmitting mechanism 95 is held in the lower position by means of the retained block 72 when the umbrella is in the opened state where the central shaft unit 20 is in the extended position and the runner 50 is in the proximate position, thereby holding the pawl end 944 in the disengaged position.

Figure 15:
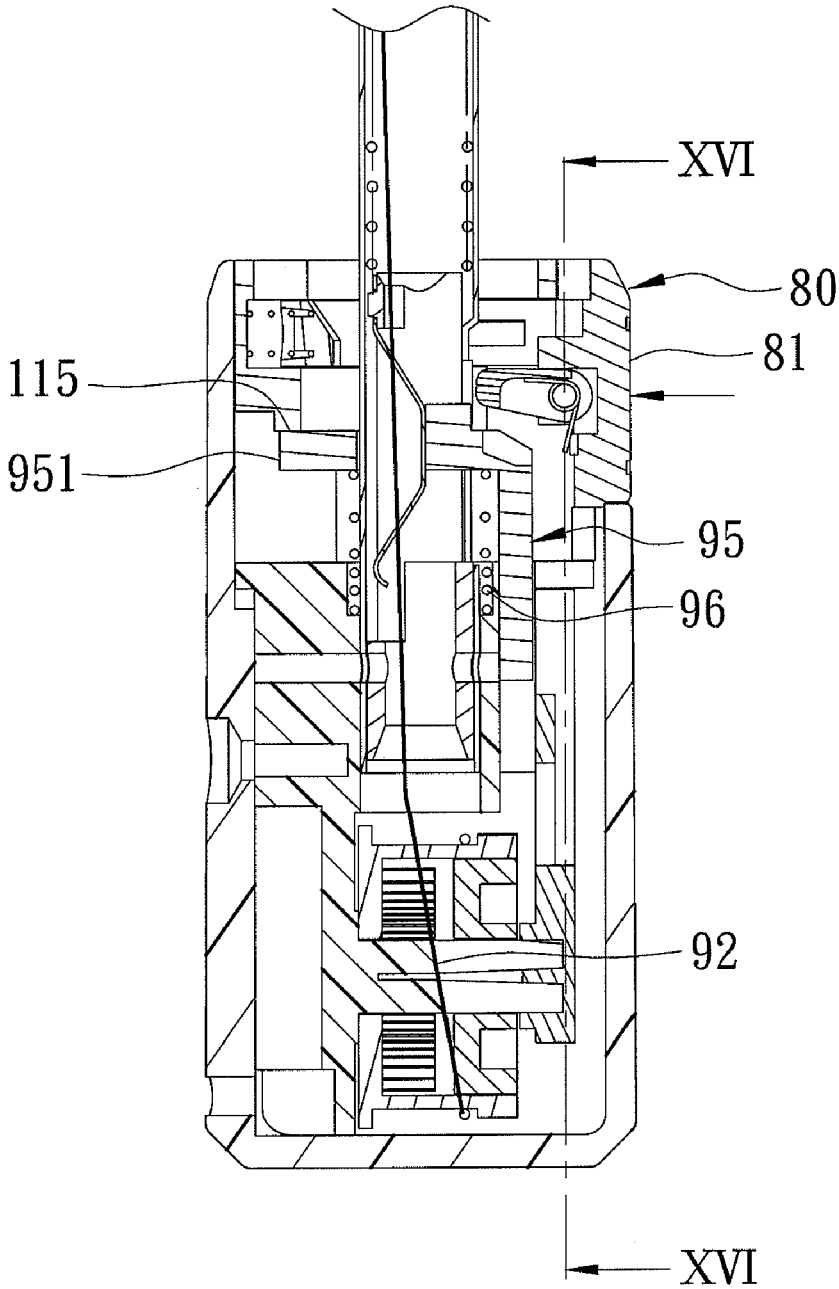
FIG. 15 is a sectional view showing the umbrella in a collapsed state.
Figure 16:
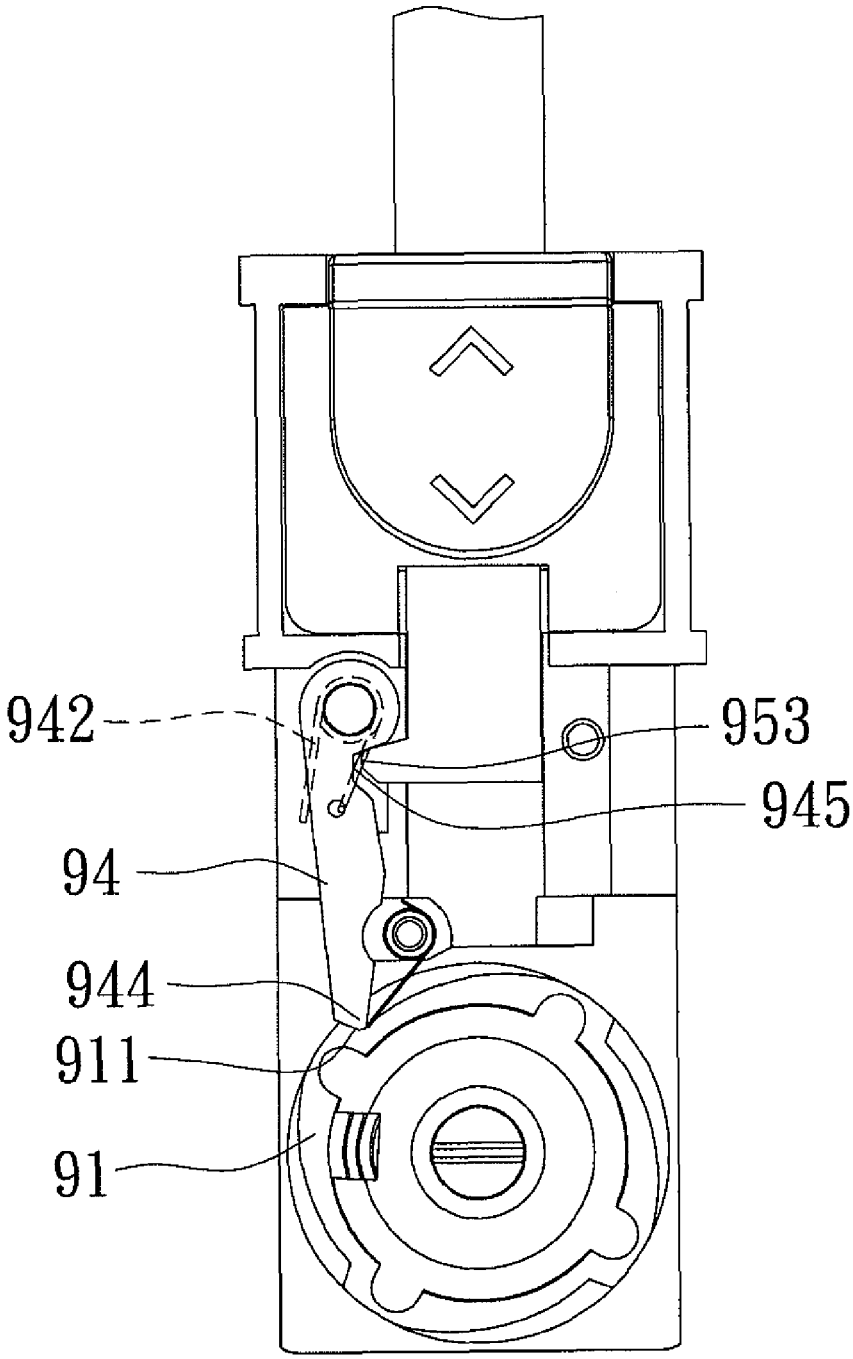
FIG. 16 is a sectional view taken along line XV-XV of FIG. 15.

Referring to FIGS. 15 and 16, similarly, when the push button 81 is pressed manually to make a lower-side stroke movement to thereby permit the retained block 72 to be released and moved upwardly, the force-transmitting mechanism 95 is moved to the upper position by the biasing action of the axially biasing member 96 to permit the abutment member 951 to abut against the ceiling portion 115. As a consequence, the pawl end 944 of the pawl member 94 is turned by the biasing action of the pawl biasing member 942 to the engaging position to engage the ratchet tooth 911.

While the present invention has been described in connection with what are considered the most practical and preferred embodiments, it is understood that this invention is not limited to the disclosed embodiments but is intended to cover various arrangements included within the spirit and scope of the broadest interpretations and equivalent arrangements.

What is claimed is:

1. A safely operable handle device for an automatic foldable umbrella, the umbrella including:

a central shaft unit including upper and lower shafts telescopically coupled to each other in an axial direction, and respectively having a top-side end and a bottom end;

a top notch secured to the top-side end to be moved therewith between folded and extended positions;

a runner slidably sleeved on the central shaft unit;

a rib-and-stretcher assembly pivotally interconnecting the top notch and the runner so as to be moved from a collapsed position to a spread position when the runner is displaced from a distal position to a proximate position relative to the top notch;

a compression spring disposed within the central shaft unit to bias the top-side end of the upper shaft, together with the top notch to move from the folded position to the extended position, and in succession, to move the runner from the distal position to the proximate position, thereby placing the rib-and-stretcher assembly in the spread position; and a first force transmission cord having a coupling end tensely moved with the top notch, and a cord segment which extends from the coupling end into the central shaft unit through winding on the runner and terminates at an anchoring end that is kept in a tugged position when the runner is displaced to the proximate position, and that is withdrawn to a released position to permit the runner to be moved to the distal position, thereby bringing the rib-and-stretcher assembly to the collapsed position, said safely operable handle device comprising:

a grip shell which is adapted to shield the bottom end of the lower shaft, and which defines a chamber therein;

a retained block which is adapted to be connected with the anchoring end of the first force transmission cord, and which is deflectable between a first orientation, where said retained block is blocked so as to hold the anchoring end in the tugged position, and a second orientation, where said retained block is movable to permit the anchoring end to be withdrawn to the released position;

a reel member which is mounted in said chamber and rotatable about a reel axis, and which has a plurality of ratchet teeth angularly displaced from one another about the reel axis;

a second force transmission cord having a connected end which is moved with one of the top notch and said retained block, and a reelable end which is secured to and is tensely reelable on said reel member;

a coil spring disposed to bias said reelable end to reel in said reel member;

a pawl member having a pawl end which is movable between an engaging position, where said pawl end is engaged with a selected one of said ratchet teeth so as to permit a unidirectional rotation of said reel member to reel in said reelable end, and a disengaged position, where said pawl end is disengaged from said ratchet teeth so as to set said reel member free to rotate, and a cammed surface;

a push button which is pressible manually to make a stroke movement relative to said grip shell;

an actuator configured to move in response to the stroke movement of said push button to activate said retained block to deflect from the first orientation to the second orientation so as to permit the runner to move from the proximate position to the distal position after the rib-and-stretcher assembly is displaced to the spread position; and a force-transmitting mechanism which is disposed in said chamber, and which is configured such that, in response to movement of said retained block to the released position, said force-transmitting mechanism is urged to move in the axial direction from a lower position to an upper position, said force-transmitting mechanism having a camming surface which is mated with said cammed surface of said pawl member such that, when said force-transmitting mechanism is moved from the lower position to the upper position, said pawl end is moved from the disengaged position to the engaging position.

2. The safely operable handle device according to claim 1, wherein said pawl member has a pivoted end disposed opposite to said pawl end and pivotally mounted on said grip shell about a pivot axis parallel to the reel axis, and a middle segment which is disposed between said pivoted end and said pawl end to have said cammed surface disposed thereon.

3. The safely operable handle device according to claim 2, further comprising a pawl biasing member disposed to bias said pawl end of said pawl member to the engaging position, and an axially biasing member disposed to bias said force-transmitting mechanism to the upper position.

4. The safely operable handle device according to claim 3, wherein said chamber has upper and lower sub-chambers to accommodate the bottom end of the lower shaft and said reel member, respectively, said force-transmitting mechanism including an abutment member which is configured to be coaxially moved relative to the bottom end of the lower shaft, and an anchored mount which extends downwardly from said abutment member toward said lower sub-chamber to terminate at a cam end that has said camming surface, said grip shell having a ceiling portion disposed in said upper sub-chamber to confront said abutment member in the axial direction such that, when said abutment member is urged by said axially biasing member to displace to the upper position, thereby abutting against said ceiling portion, by virtue of sweeping engagement of said camming surface with said cammed surface, said pawl end is displaced from the disengaged position to the engaging position.

5. The safely operable handle device according to claim 4, wherein said grip shell has an anchored portion, said force-transmitting mechanism further including a lever which has a fulcrum pivotally mounted on said anchored mount, a power end disposed to be pressible by a lower-side stroke movement of said push button, and a weight end disposed to be turned, in response to the lower-side stroke movement of said push button, from an anchoring position, where said weight end anchors said anchored portion so as to keep said force-transmitting mechanism in the lower position, to a non-anchoring position, where said weight end is disengaged from said anchored portion so as to permit displacement of said force-transmitting mechanism to the upper position, and a lever biasing member which is disposed to bias said weight end to the anchoring position.

6. The safely operable handle device according to claim 5, further comprising a press member which is adapted to extend from the runner in the axial direction and terminates at a lower press portion that is configured to counteract said abutment member against the biasing action of said axially biasing member so as to keep said force-transmitting mechanism in the lower position.

7. The safely operable handle device according to claim 6, wherein said press member has a retaining hole, said push button having a retained protrusion which is disposed to be retained in said retaining hole so as to hold the top notch in the folded position against a biasing force of the compression spring and which is disposed to be releasable from said retaining hole in response to an upper-side stroke movement of said push button.

8. The safely operable handle device according to claim 4, wherein said actuator has a pressed end configured to move in response to a lower-side stroke movement of said push button, and an actuating end which is moved by said pressed end to activate said retained block to deflect from the first orientation to the second orientation.

9. The safely operable handle device according to claim 8, wherein said pressed end of said actuator is pivotably mounted on said push button such that said actuating end is turnable between a non-actuatable position, where said actuating end is disengaged from said retained block, and an actuatable position, where said actuating end is engaged with said retained block.

10. The safely operable handle device according to claim 4, further comprising a press member which is adapted to extend from the upper shaft away from the top notch to terminates at a lower press portion that is configured to counteract said abutment member against the biasing action of said axially biasing member so as to keep said force-transmitting mechanism in the lower position, said press member having a retaining hole, said push button having a retained protrusion which is configured to be retained in said retaining hole so as to hold the top notch in the folded position against a biasing force of the compression spring and which is disposed to be releasable from said retaining hole in response to an upper-side stroke movement of said push button.

* * * * *